US008973512B2

(12) United States Patent
Dunn

(10) Patent No.: US 8,973,512 B2
(45) Date of Patent: Mar. 10, 2015

(54) WIND GUST DAMPENING SYSTEM FOR SAILING VESSEL

(71) Applicant: Gilbert D. Dunn, Stuart, FL (US)

(72) Inventor: Gilbert D. Dunn, Stuart, FL (US)

( * ) Notice: Subject to any disclaimer, the term of this patent is extended or adjusted under 35 U.S.C. 154(b) by 99 days.

(21) Appl. No.: 13/748,965

(22) Filed: Jan. 24, 2013

(65) Prior Publication Data

US 2013/0186319 A1 Jul. 25, 2013

Related U.S. Application Data

(60) Provisional application No. 61/590,077, filed on Jan. 24, 2012.

(51) Int. Cl.
*B63H 9/04* (2006.01)
*B63H 9/08* (2006.01)
*B63H 9/10* (2006.01)

(52) U.S. Cl.
CPC ... *B63H 9/08* (2013.01); *B63H 9/10* (2013.01)
USPC ..... 114/102.12

(58) Field of Classification Search
CPC ..... B63H 9/10; B63H 9/0607; B63H 9/1085; B63H 2009/086; B63H 2009/088; B63H 35/7989
USPC ..... 114/102.1, 102.12, 102.18, 102.15, 114/102.19, 102.2, 102.21, 108, 101, 204, 114/205, 213, 216, 214, 215
See application file for complete search history.

(56) References Cited

U.S. PATENT DOCUMENTS

| | | | | | |
|---|---|---|---|---|---|
| 384,008 | A | * | 6/1888 | Wheeler | 267/71 |
| 2,771,291 | A | * | 11/1956 | Holliday et al. | 267/292 |
| 3,090,340 | A | | 5/1963 | McCutchen et al. | |
| 3,795,218 | A | | 3/1974 | Merry | |
| 4,067,280 | A | | 1/1978 | Serfess | |
| 4,345,535 | A | | 8/1982 | Ross | |
| 4,385,579 | A | | 5/1983 | Baulard-Caugan | |
| 4,515,100 | A | | 5/1985 | Grierson | |
| 4,620,499 | A | | 11/1986 | Slemmons | |
| 4,625,672 | A | | 12/1986 | Jackson | |
| 4,671,198 | A | | 6/1987 | des Snead | |
| 4,762,318 | A | * | 8/1988 | Phillips et al. | 482/126 |
| 4,854,255 | A | | 8/1989 | Kief | |
| 4,885,824 | A | * | 12/1989 | Schwab et al. | 24/17 B |
| 4,977,843 | A | | 12/1990 | Ewert et al. | |
| 5,277,683 | A | | 1/1994 | Wilkins | |
| 5,372,081 | A | | 12/1994 | Mayer | |
| 5,535,692 | A | | 7/1996 | Ezzy | |
| 5,697,314 | A | | 12/1997 | Clausin | |
| 5,778,814 | A | | 7/1998 | Taylor | |

(Continued)

*Primary Examiner* — Lars A Olson
*Assistant Examiner* — Anthony Wiest
(74) *Attorney, Agent, or Firm* — Akerman LLP; Michael K. Dixon

(57) ABSTRACT

A wind gust dampening system for a sailing vessel for absorbing the forces generated by a wind gust upon a sail is disclosed. The wind gust dampening system may be adjustable such that the system may be used on a variety of different size and types of sailing vessels to absorb forces from wind gusts to prevent sailing vessels from capsizing or from damage occurring to equipment, or both. The configuration of the wind gust dampening system provides for a plurality of adjustments enabling the system to be uniquely adapted to each sailing vessel for increased efficiency. The wind gust dampening system may include one or more shock cords for absorbing the forces generated by wind gusts and may extend between a deck of a vessel and a sail.

18 Claims, 16 Drawing Sheets

(56) References Cited

U.S. PATENT DOCUMENTS

| | | | | |
|---|---|---|---|---|
| 5,848,574 | A | 12/1998 | Lande | |
| 6,148,753 | A | 11/2000 | Shore | |
| 6,718,898 | B1 | 4/2004 | Anderson | |
| 6,932,010 | B1 | 8/2005 | Hoyt | |
| 7,032,529 | B2 * | 4/2006 | Sanford | 114/230.2 |
| 7,987,802 | B2 * | 8/2011 | Niedermair | 114/218 |
| 2010/0136873 | A1 | 6/2010 | Hollis | |
| 2011/0168072 | A1 | 7/2011 | Cross | |

* cited by examiner

WIND GUST DAMPENING SYSTEM FOR SAILING VESSEL

CROSS-REFERENCE TO RELATED APPLICATION

This patent application claims priority to U.S. Provisional Patent Application No. 61/590,077, filed Jan. 24, 2012, which is incorporated by reference in its entirety.

FIELD OF THE INVENTION

The invention relates to sailing systems, and more particularly, to sail securement systems for securing sails to vessels.

BACKGROUND

Sails on sailing vessels are typically supported by a vertically extending mast and a horizontally extending boom, such as a main boom or a jib boom. The sail may also be supported by a back stay extending from the mast head to the stern of the sailing vessel. The main boom may be controlled with a main sheet attached to a deck of the sailing vessel. The main sheet may be taken up or let out while sailing to account for wind speed and heading of the vessel relative to the wind direction. The main sheet is typically releasably fastened to the deck of the sailing vessel and is typically a line having little stretch. While sailing, wind strikes the sail and imparts a force on the sail causing forward motion when the sailing vessel is pointed generally orthogonal to a direction in which the wind is blowing. The main sheet is adjusted based on the wind speed of the day. In gusty conditions, the wind gusts cause the sailing vessel to roll or heel. The keel of the vessel counteracts the wind gust but does not prevent the sailing vessel from heeling. In conditions with heavy wind gusts, the sailing vessel is subject to sever heeling and possibly capsizing.

SUMMARY OF THE INVENTION

A wind gust dampening system for a sailing vessel for absorbing the forces generated by a wind gust upon a sail is disclosed. The wind gust dampening system may be adjustable such that the system may be used on a variety of different size and types of sailing vessels to absorb forces from wind gusts to prevent sailing vessels from capsizing or from damage occurring to equipment, or both. The configuration of the wind gust dampening system provides for a plurality of adjustments enabling the system to be uniquely adapted to each sailing vessel for increased efficiency. The wind gust dampening system may include one or more shock cords for absorbing the forces generated by wind gusts and may extend between a deck of a vessel and a sail.

The wind gust dampening system may be used with any sailing vessel that uses a line, which is known as a sheet, to control the sail. One end of the wind gust dampening system may be attached to the sheet by a deflection guide and a cam cleat. The other end of the wind gust dampening system may be attached to a fixed point on the sailing vessel through use of a line, such as, but not limited to, a rope, that is attached at the other end to aspects of the wind gust dampening system. The wind gust dampening system may include various sized shock cords attached to one of two bodies forming the wind dampening system. The shock cords can be easily engaged or disengaged, which enables the amount of tension to be changed. The wind gust dampening system thus provides an adjustable shock absorbing capability between the sheet and the sailboat itself.

The wind gust dampening system does not require any additional hardware to be installed on a vessel. The wind gust dampening system may be ready to use out of the box. Additionally, the wind gust dampening system may be attached to a sheet even while the sheet is under load.

The size of the wind gust dampening system may be varied depending on the diameter of the sheet and the surface area of the sail to which the wind gust dampening system is attached. The wind gust dampening system may be formed from materials, such as, but not limited to, plastic and metal.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
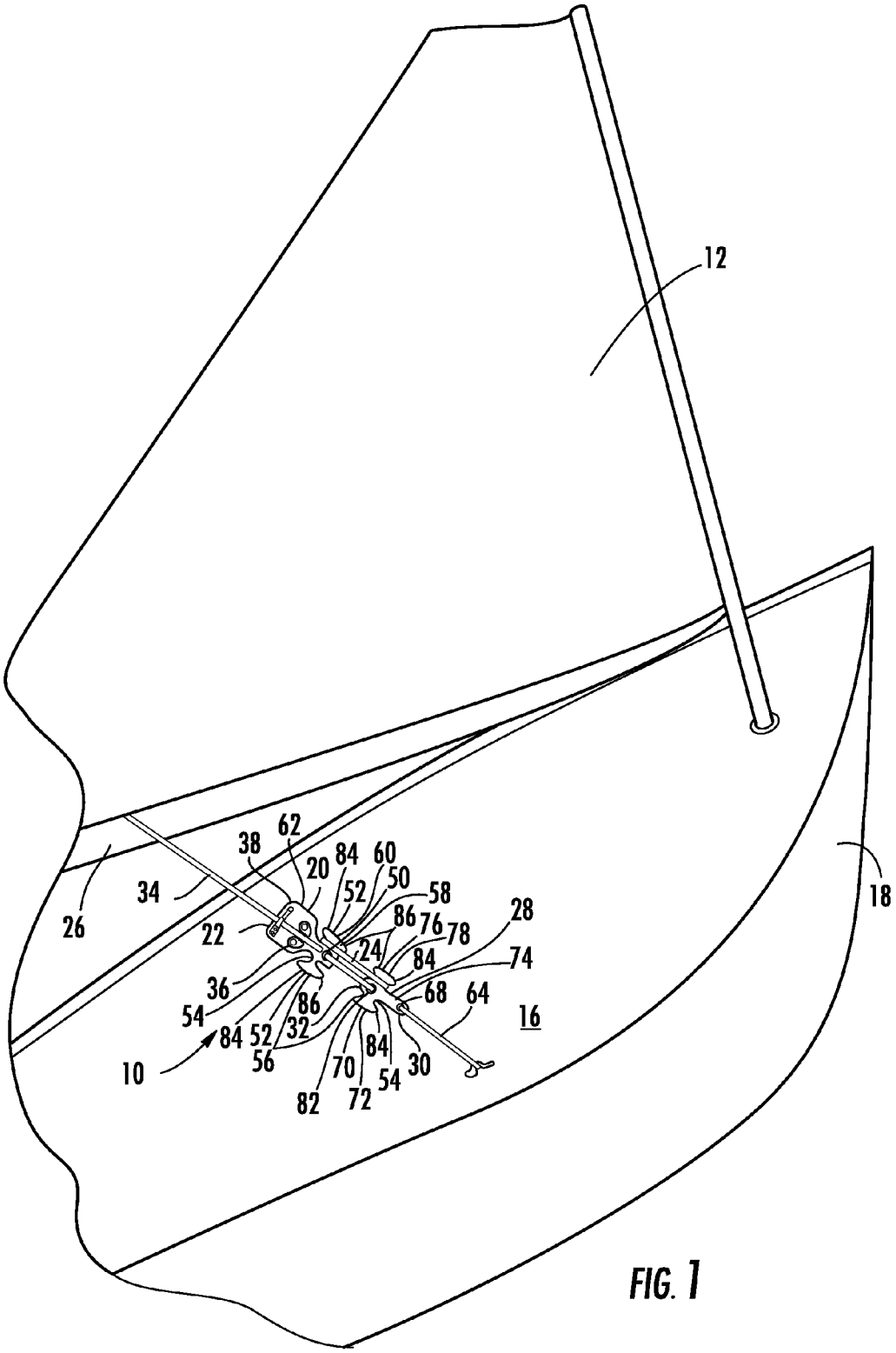
FIG. 1 is a perspective view of a wind gust dampening system installed on a sailing vessel.

As shown in FIGS. 1-20, a wind gust dampening system 10 for a sailing vessel for absorbing the forces generated by a wind gust upon a sail 12 is disclosed. The wind gust dampening system 10 may be adjustable such that the system 10 may be used on a variety of different size and types of sailing vessels 18 to absorb forces from wind gusts to prevent sailing vessels 18 from capsizing or from damage occurring to equipment, or both. The configuration of the wind gust dampening system 10 provides for a plurality of adjustments enabling the system 10 to be uniquely adapted to each sailing vessel 18 for increased efficiency. The wind gust dampening system 10 may include one or more shock cords 14 for absorbing the forces generated by wind gusts and may extend between a deck 16 of a vessel 18 and a sail 12.

As shown in FIGS. 1-3, 5, 7, 9 and 13, the wind gust dampening system 10 may be formed from a first body 20 having a first end 22 and a second end 24 positioned on an opposite side of the first body 20. The first end 22 of the first body 20 may be configured to be secured to a support structure 26 for a sail 12. The support structure 26 may be, but is not limited to being, a boom. The wind gust dampening system 10 may include a second body 28, as shown in FIGS. 1, 2, 4, 9, 10 and 14, having a first end 30 and a second end 32 positioned on an opposite side of the second body 28, wherein the first end 30 of the second body 28 is configured to be secured to a vessel 18, such as, but not limited to, a deck 16 of a vessel 18. The wind gust dampening system 10 may include one or more shock cords 14 extending between the first and second bodies 20, 28.

As shown in FIGS. 1-3, 5, 7, 9 and 13, the first body 20 may include a first line 34 extending from the first end 22 of the first body 20. The first line 34 may be, but is not limited to being, a nylon rope having a diameter between about one quarter of an inch and about two inches. The first line 34 may be releasably coupled to the first end 22 of the first body 20 via a releasable clamp 36 on the first body 20. The releasable clamp 36 may be, but is not limited to being, a cam cleat. The opposite end of the first line 34 may be attached to the support structure 26 for the sail 12, to the sail, or both. The first line may be permanently or releasably attached thereto.

Figure 6:
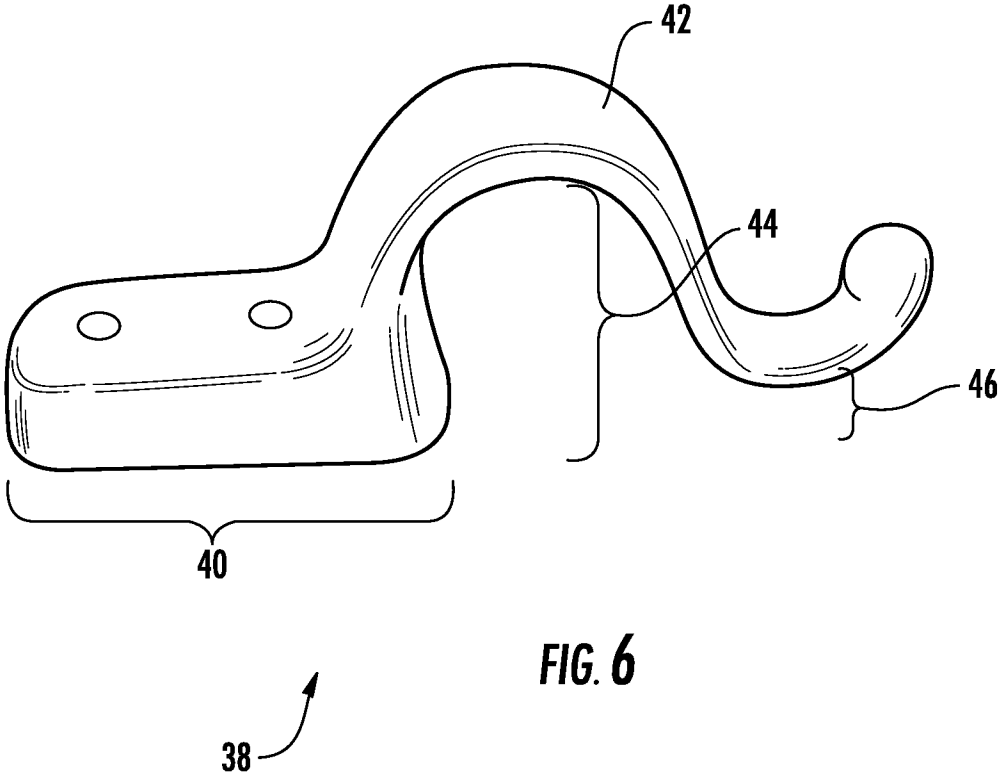
FIG. 6 is a perspective view of a deflection guide of the wind gust dampening system.

The first body 20 may also include one or more deflection guides 38, as shown in FIG. 6, formed from a base 40 attached to the first body 20 and having an arm 42 extending from the base 40 and terminating proximate to the first body 20, thereby forming a line containing chamber 44 and an opening 46 into the chamber 44 between the arm 42 and the first body 20. The opening 46 may be positioned on an opposite side of the arm 42 from the base 40. The arm 42 may have any appropriate shape, such as, but not limited to, an S shape. The line containing chamber 44 may be sized to house a line extending therethrough.

In one embodiment, the deflection guide 38 may be positioned adjacent to the first end 22. The cam cleat 36 may also be positioned between the deflection guide 38 at the first end 22 and the orifice 50 at the second end 24. The first body 20 may also include one or more retainers 52 having one or more load bearing surfaces 54 configured to retain the shock cord 14 extending from a first side 56 of the elongated body 62, a second retainer 58 extending from a second side 60 of the elongated body 62 in a direction generally opposite to a direction in which the first end 22 extends from the elongated body 62.

Figure 9:
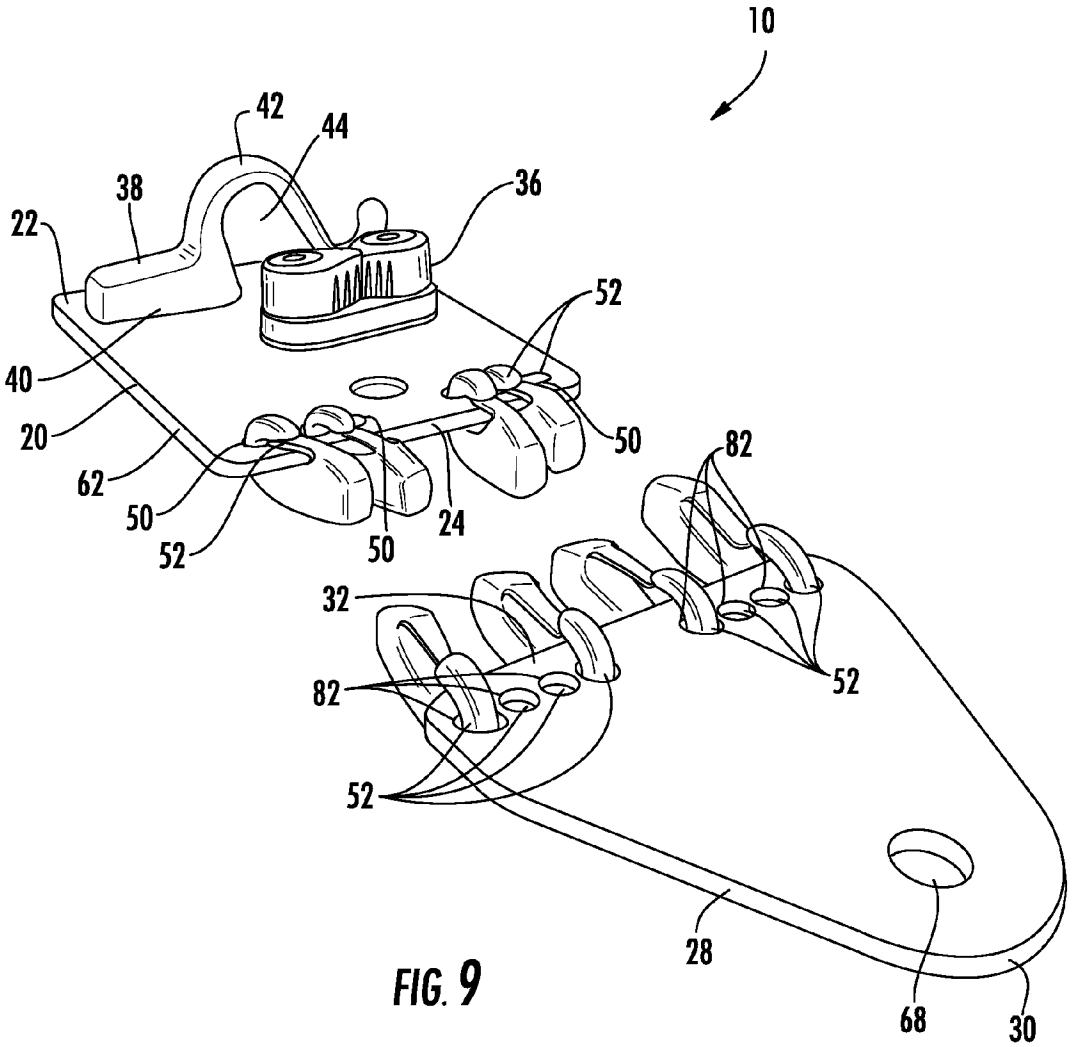
FIG. 9 is a perspective view of another embodiment of the wind gust dampening system.

In another embodiment, as shown in FIG. 9, the first body 20 may include a plurality of orifices 50 at the second end 24 to which a plurality of shock cords 14 are releasably attached. The first body 20 may be generally rectangular or have another appropriate configuration.

As shown in FIGS. 1, 2, 4, 9, 10 and 14, the second body 28 may have any configuration for coupling the shock cords 14 to a second line 64 that is attachable to a deck 16 of a vessel 18. The second body 28 may be formed from any configuration enabling the shock cords 14 to be coupled to the second line 64 that is attachable to a deck 16 of a vessel 18. In one embodiment, the second body 28 may be formed from an elongated body 74 wherein the first end 30 includes an orifice 68, a first retainer 70 extending from a first side 72 of the elongated body 74, a second retainer 76 extending from a second side 78 of the elongated body 74 in a direction generally opposite to a direction in which the first end 30 extends from the elongated body 74, and an orifice 68 in the elongated body 74 at the second end 32. A second line 64 may extend from the first end 30 of the second body 28.

Figure 10:
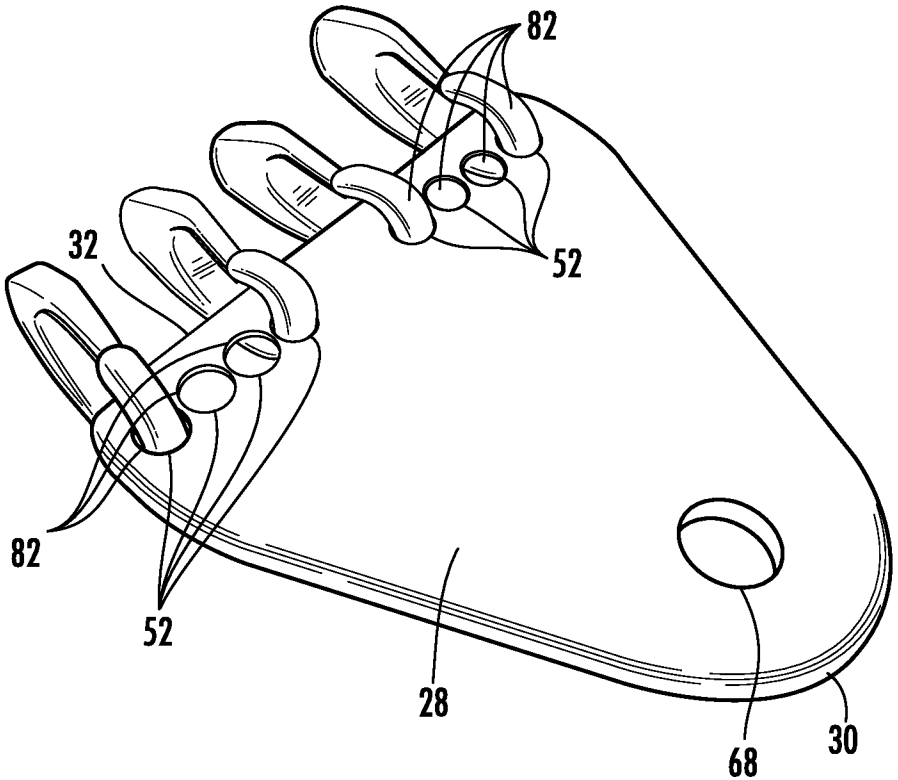
FIG. 10 is a perspective view of another embodiment of the second body of the wind gust dampening system shown in FIG. 9.

In another embodiment, as shown in FIGS. 9 and 10, the second body 28 may be generally triangular. The first end 30 of the second body 28 may be configured to be secured to a deck 16 of a vessel 18, and a side opposite to the first end 30 may include a plurality of orifices 82.

Figure 2:
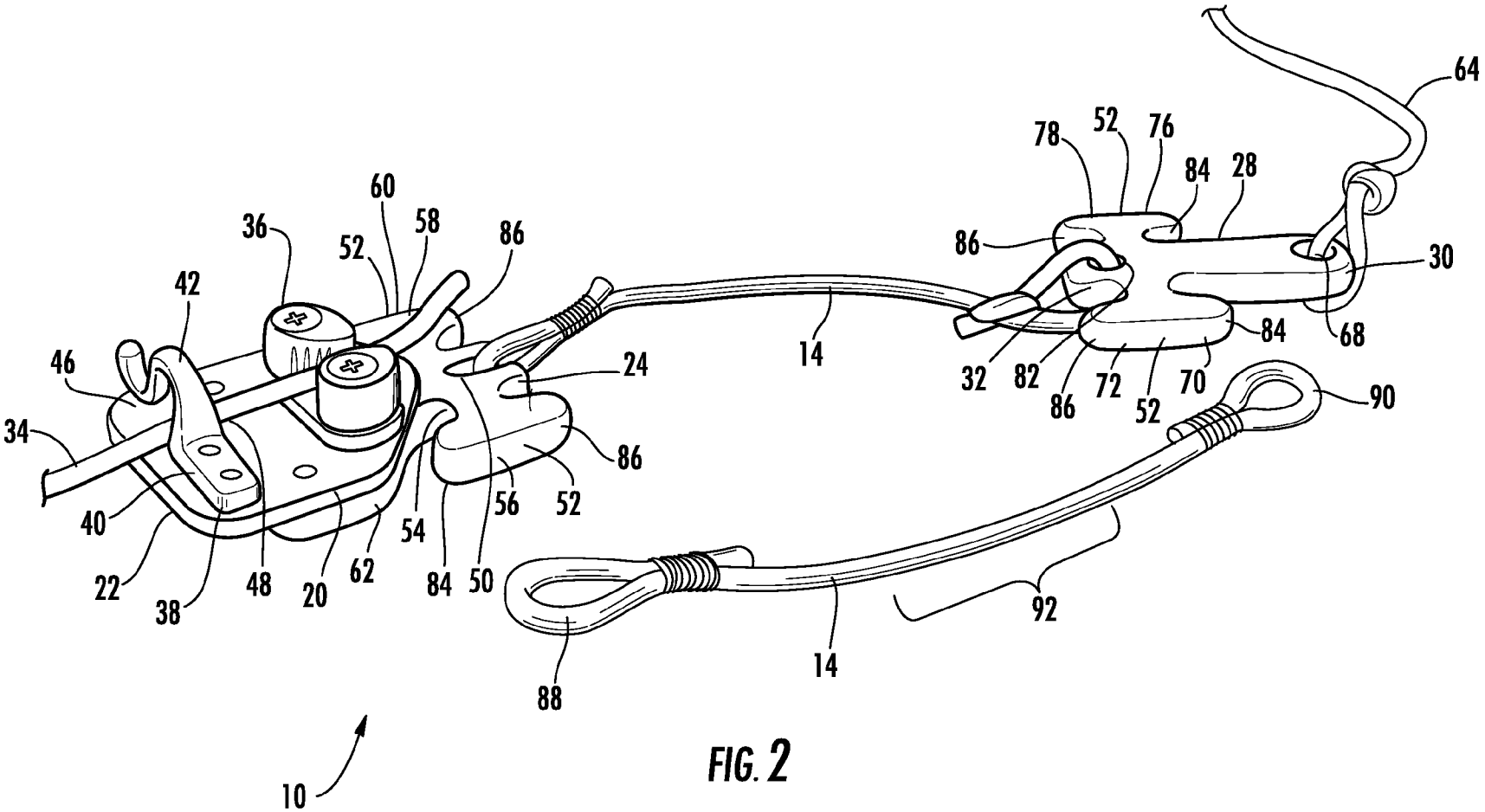
FIG. 2 is a perspective view of the wind gust dampening system.
Figure 3:
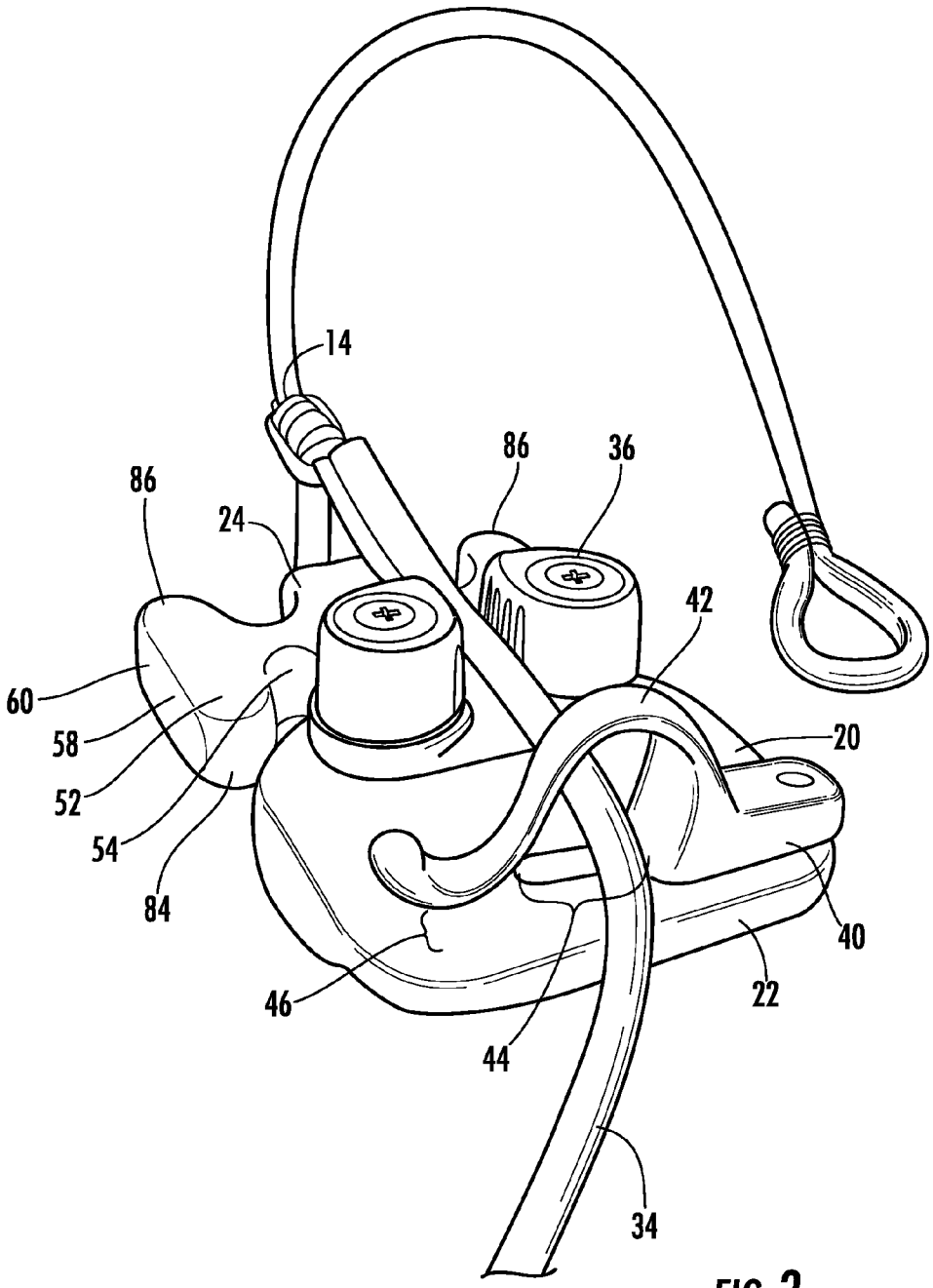
FIG. 3 is a perspective view of the first body of the wind gust dampening system.
Figure 4:
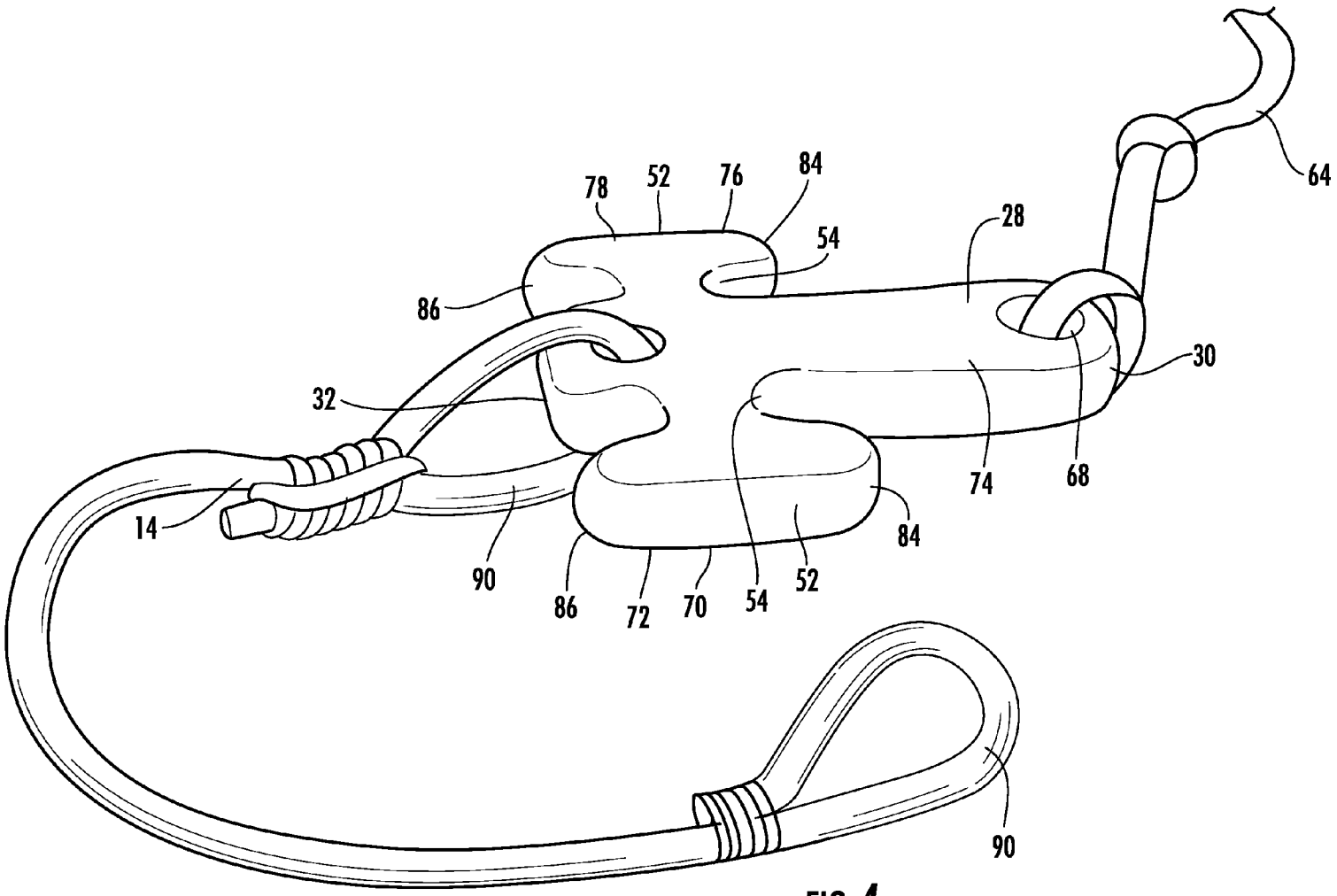
FIG. 4 is a perspective view of the second body of the wind gust dampening system.
Figure 5:
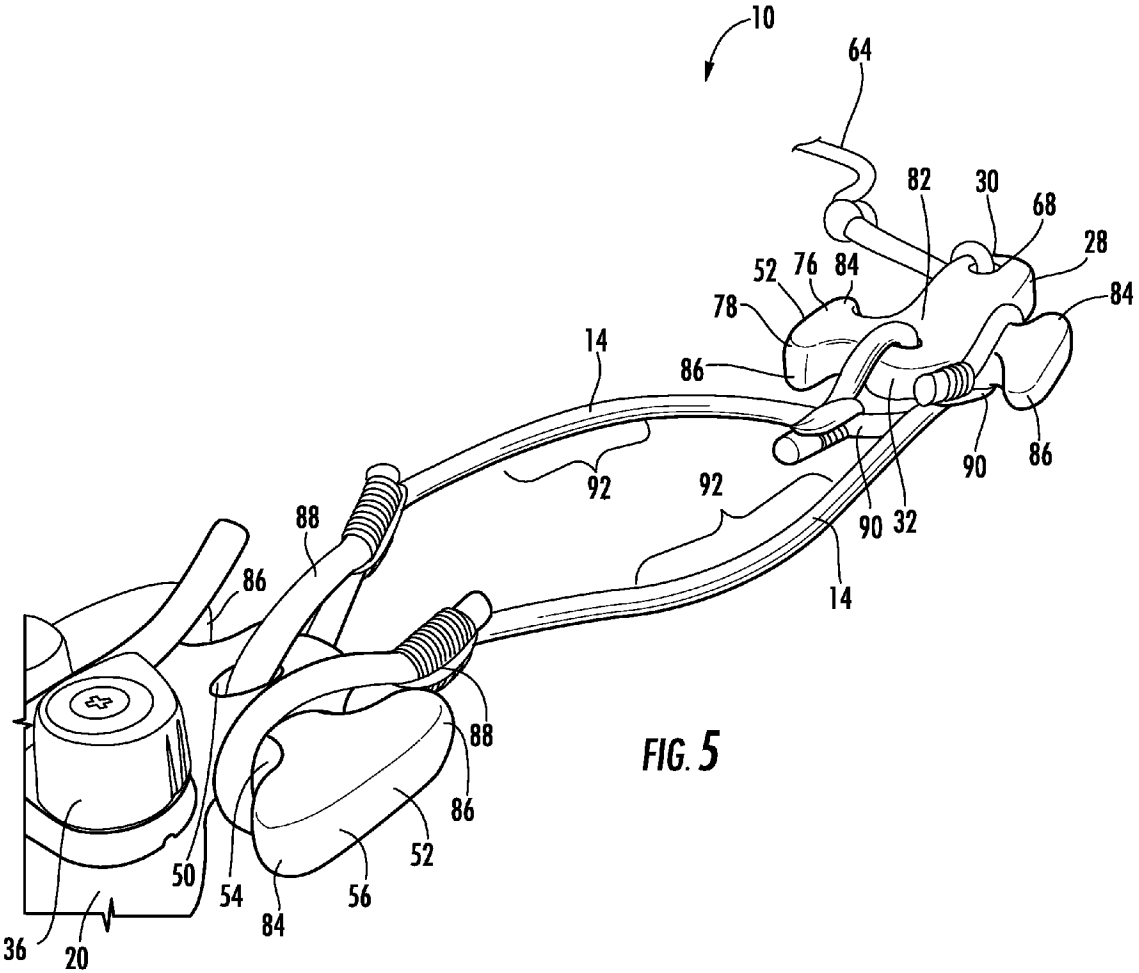
FIG. 5 is a perspective view of the wind gust dampening system with multiple shock cords.

The wind gust dampening system 10 may have one or more shock cords 14 for absorbing the forces generated by wind gusts. In one embodiment, one or more shock cords 14 may be releasably coupled to the first or second bodies 20, 28, or both. In another embodiment, one or more shock cords 14 may be permanently attached to the first or second bodies 20, 28, or both. In particular, as shown in FIGS. 2 and 5, a shock cord 14 may be attached via a permanent loop to an orifice 50 in the first body 20, and the shock cord 14 may be attached via a permanent loop to an orifice 82 in the second body 28. Additional shock cords 14 may be is releasably attached to the first and second bodies 20, 28. The shock cords 14 may be sized, diameter and length, based upon the anticipated loads. The number of shock cords 14 used may be based upon the anticipated loads.

The first body 20 may include one or more retainers 52 having one or more load bearing surfaces 54 configured to retain the shock cord 14. The retainer 52 may be, but is not limited to being, a hook 84. The hook 84 may or may not include a loop retaining protrusion 86 to prevent the shock cord 14 from inadvertently being removed from the retainer 52.

Figure 11:
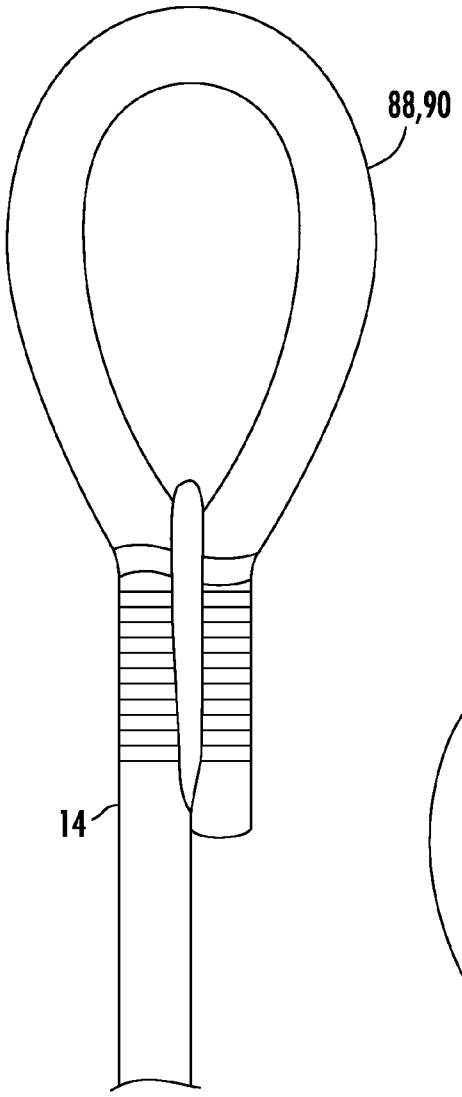
FIG. 11 is a front view of an end of a shock cord of the wind gust dampening system.
Figure 12:
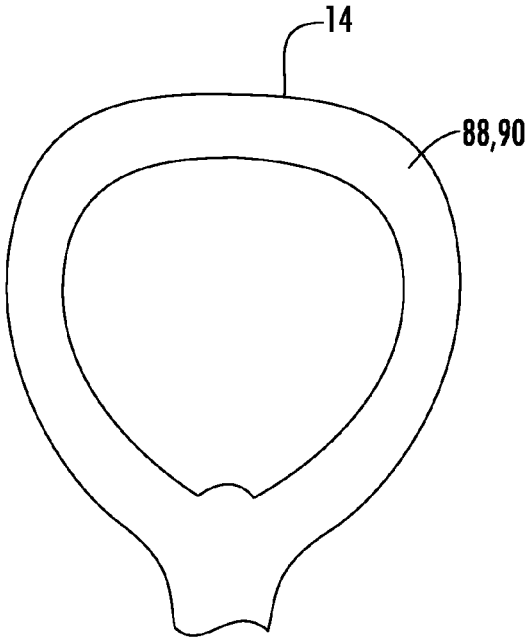
FIG. 12 is a front view of an alternative configuration of the end of the shock cord shown in FIG. 11 expanded to fit onto the hook.

The shock cord 14 may be releasably attached to the second body 28. In one embodiment, as shown in FIGS. 11 and 12, the shock cord 14 may be releasably attached with one or more loops 88, 90. The second body 28 may include one or more retainers 52 having one or more load bearing surfaces 54 configured to retain one or more shock cords 14. In at least one embodiment, the retainer 52 on the second body 28 may be, but is not limited to being, a hook 84. The hook 84 may include a loop retaining protrusion 86. The retainer 52 in the second body 28 may be formed from a plurality of orifices 68 at an end to which a plurality of shock cords 14 are releasably attached. The system 10 may include use of a plurality of shock cords 14. The shock cords 14 may have the same size and length or may have different sizes or lengths, or both.

Figure 7:
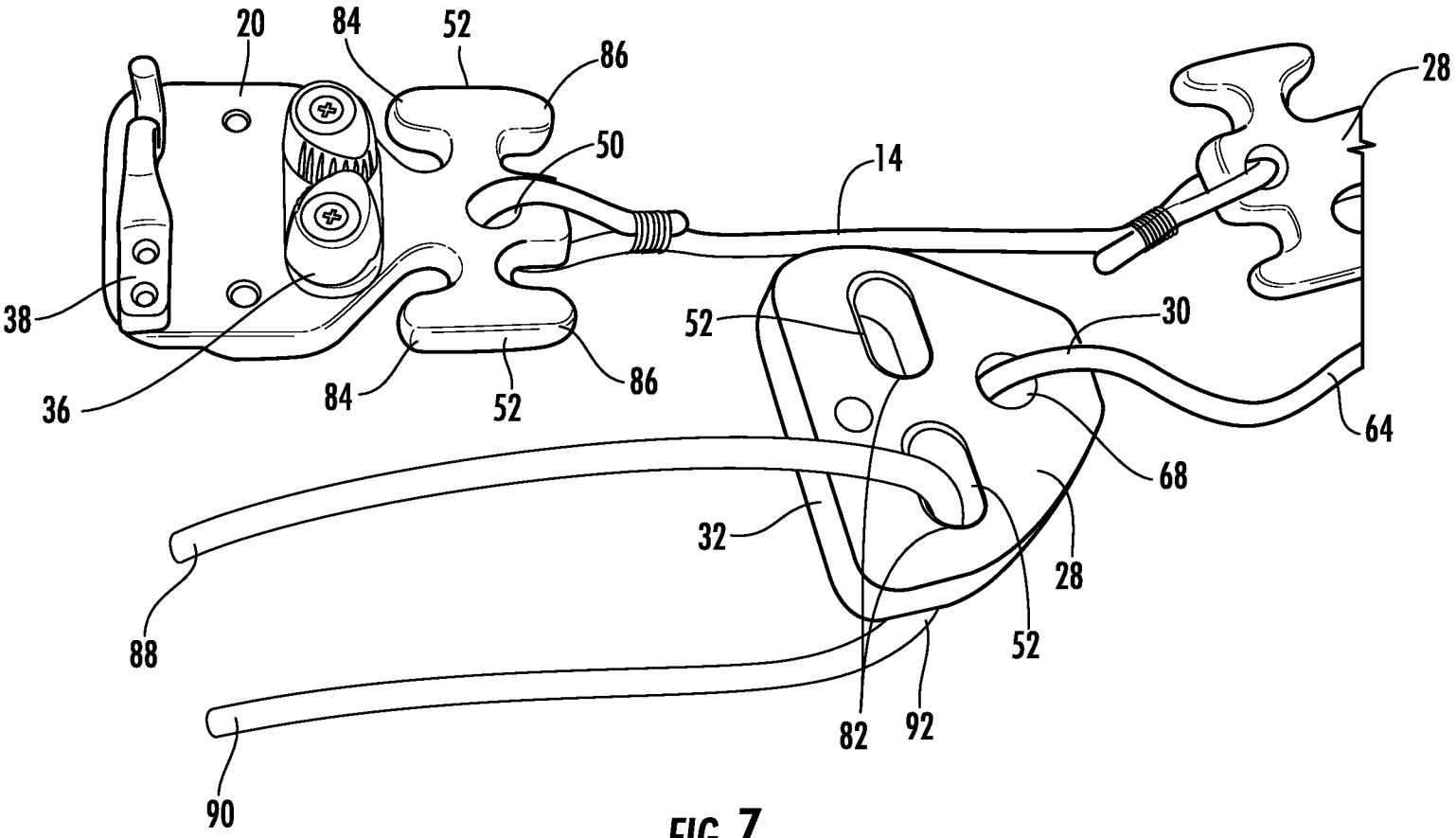
FIG. 7 is a perspective view of another embodiment of the wind gust dampening system.
Figure 8:
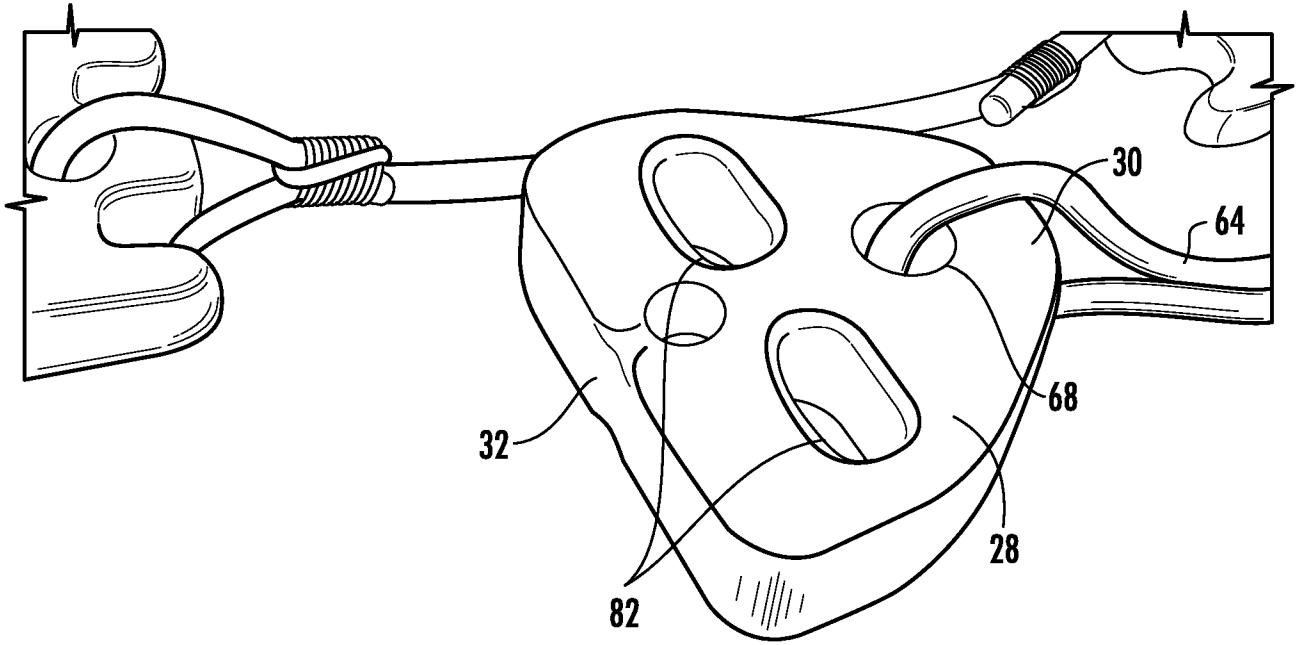
FIG. 8 is a perspective view of the second body of the wind gust dampening system shown in FIG. 7.
Figure 13:
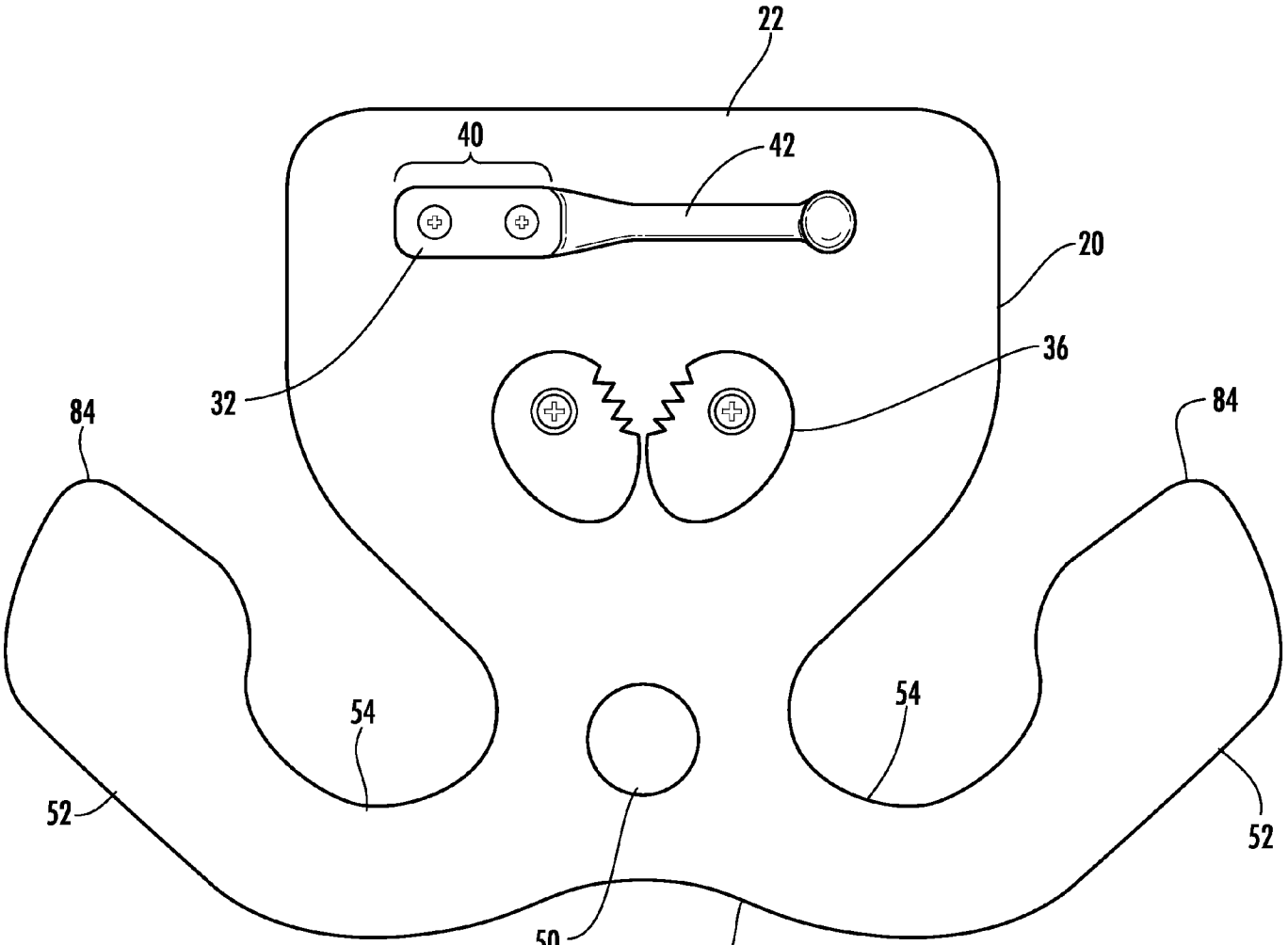
FIG. 13 is a top view of an alternative embodiment of the first body of the wind gust dampening system.
Figure 14:
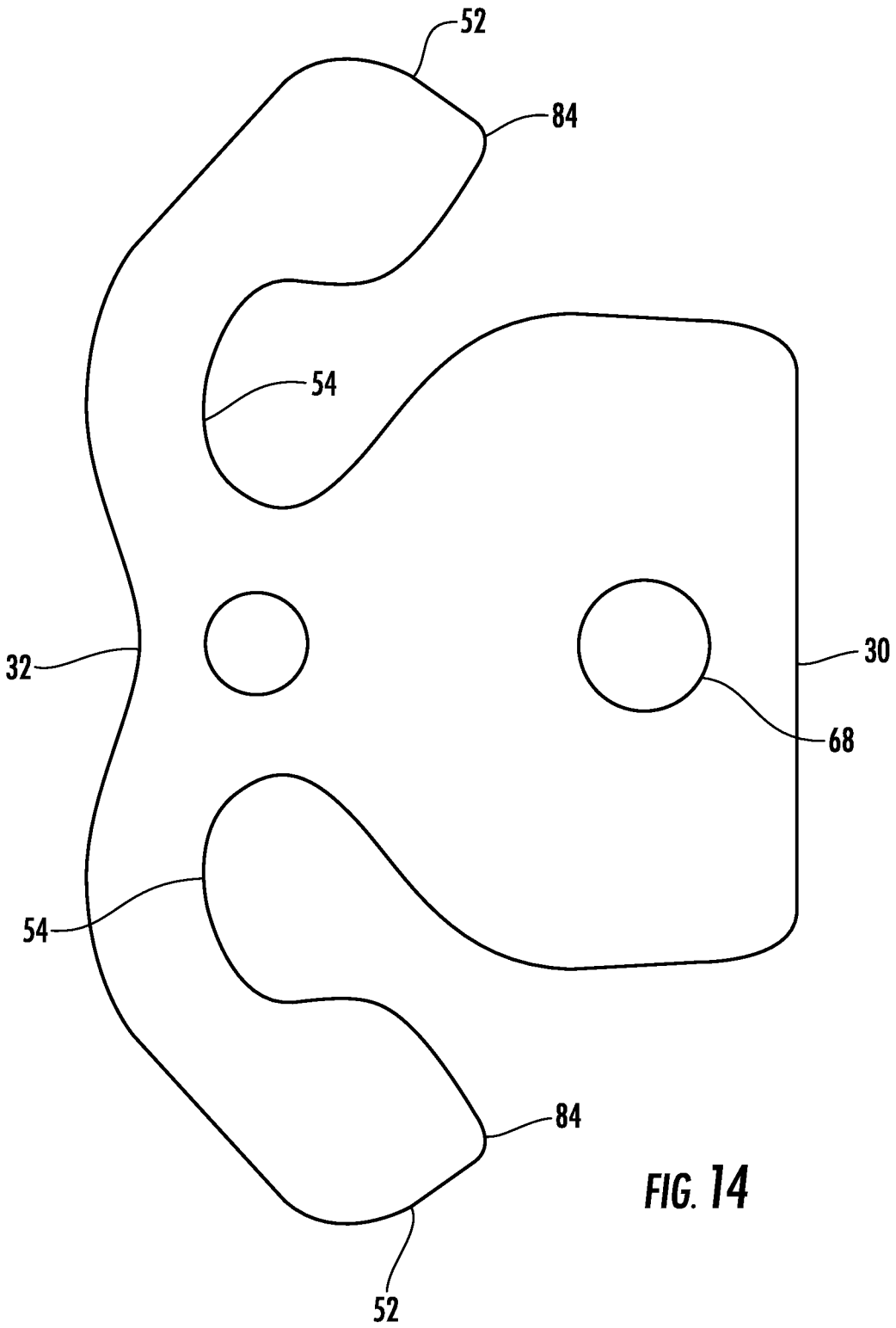
FIG. 14 is a top view of an alternative embodiment of the second body of the wind gust dampening system.
Figure 15:
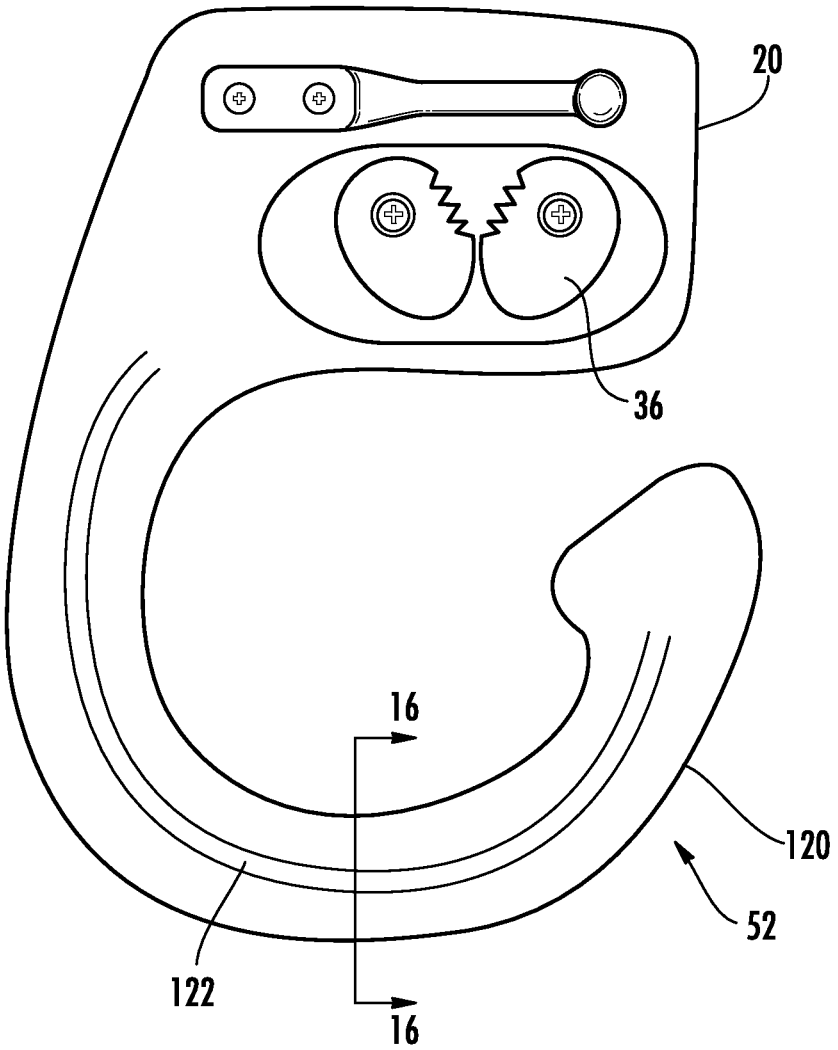
FIG. 15 is a top view of an alternative embodiment of the first body of the wind gust dampening system.

In another embodiment as shown in FIGS. 7 and 8, the second body 28 may include one or more retainers 52 configured to hold one or more shock cords 14 such that first and second ends 88, 90 of the shock cords 14 are coupled to the first body 20 and midsections 92 of the shock cords 14 extend through the retainer 52 in the second body 28. Thus, the shock cords 14 may be looped through the retainers 52, thereby reducing the effective length of the shock cords 14 by about one half. The retainers 52 may be formed from at least one orifice 82 in the second body 28, a hook or other appropriate device. In yet another embodiment, as shown in FIGS. 13 and 14, first and second bodies 20, 28, include retainers 52 without a loop retaining protrusion 86.

Figure 16:
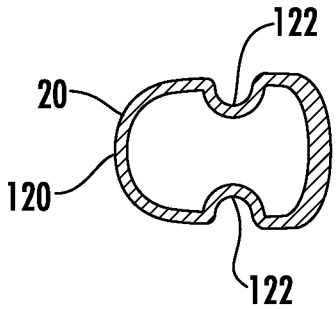
FIG. 16 is a cross-sectional view of a portion of the first body taken along section line 16-16 in FIG. 15.
Figure 17:
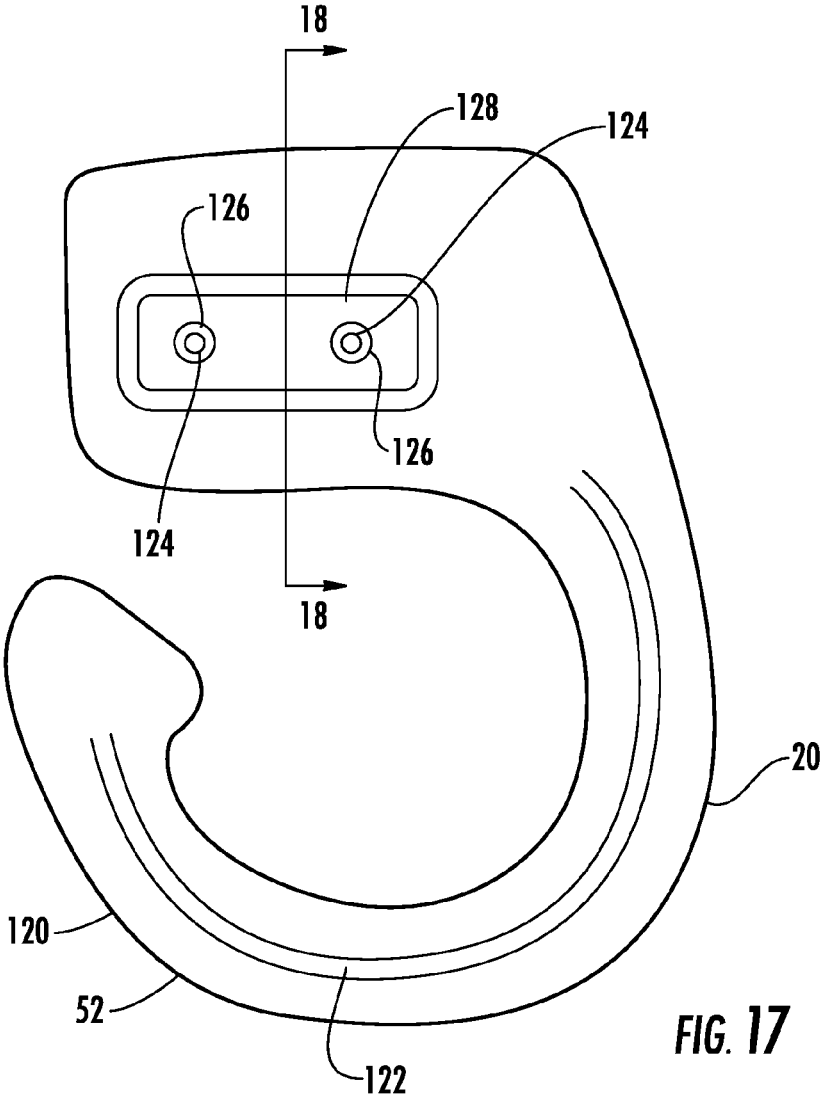
FIG. 17 is a bottom view of the alternative embodiment of the first body shown in FIG. 15.
Figure 18:
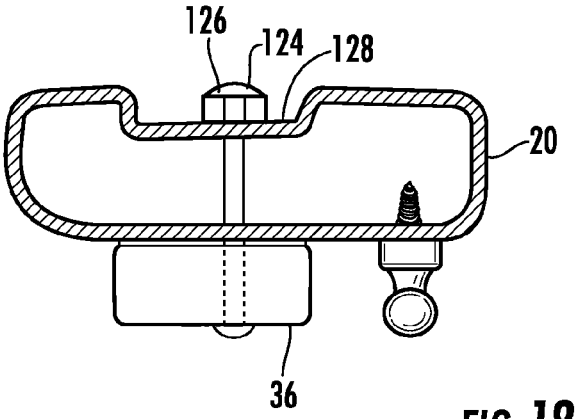
FIG. 18 is a cross-sectional view of a portion of the first body taken along section line 18-18 in FIG. 17.
Figure 19:
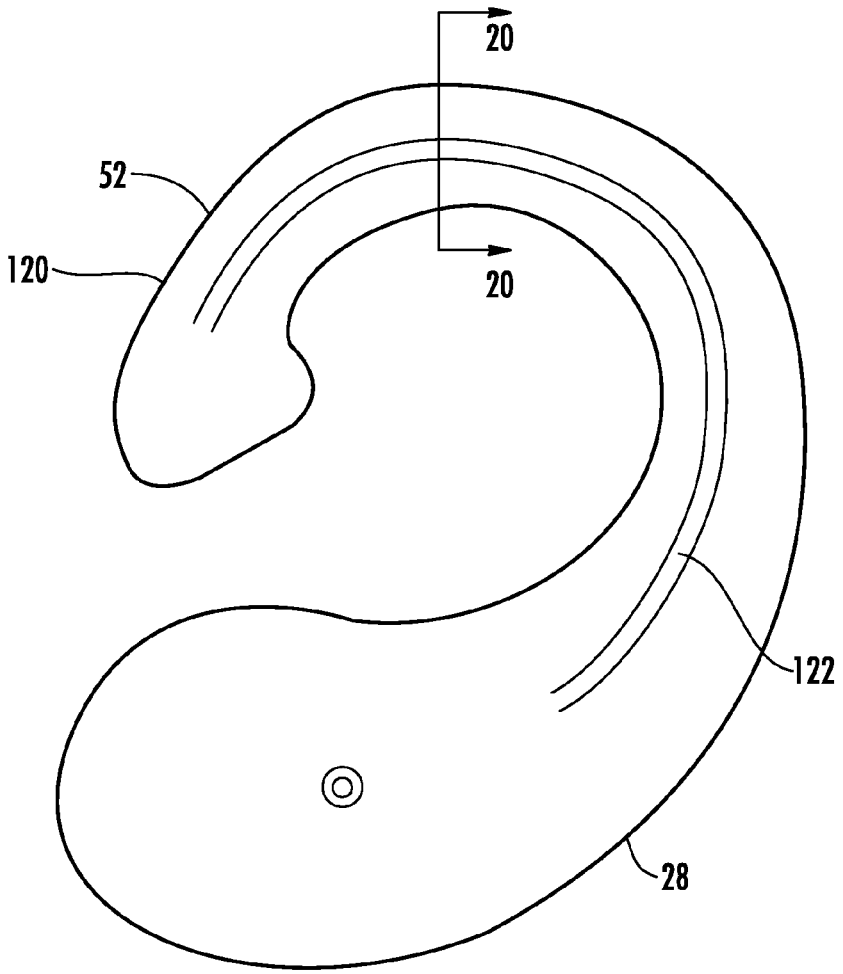
FIG. 19 is a top view of an alternative embodiment of the second body of the wind gust dampening system.
Figure 20:
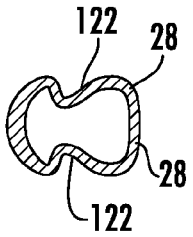
FIG. 20 is a cross-sectional view of a portion of the first body taken along section line 20-20 in FIG. 19.

In an alternative embodiment, as shown in FIGS. 16-20, the first body 20 may include a retainer 52 formed from a single hook 120. The hook 120 may have any appropriate configuration shaped to retain one or more shock cords 14. As shown in FIG. 16, aspects of the first body 20 forming the hook 120 may be hollow and may include one or more exterior channels 122 to reduce weight and increase strength. The second body 28 may include a retainer 52 formed from a single hook 120. As shown in FIGS. 17 and 18, aspects of the first body 20 forming the hook 120 may be hollow and may include one or more exterior channels 122 to reduce weight and increase strength. In addition, one or more connecters 124, such as but not limited to, nuts and bolts, may be used to couple the releasable clamp 36 to the first body 20. The nuts 126 may be contained within a recess 128 in the first body 20. The second body 28, as shown in FIGS. 19 and 20, may include aspects forming a retainer 52, which may be, but is not limited to being, one or more hooks 120 that may be hollow and may include one or more exterior channels 122 to reduce weight and increase strength.

During use, the wind gust dampening system 10 may be attached before a sheet is placed under load or while a sheet is under load. A line extending from the second body 28 may secured to the vessel 18 such as by being attached to a cleat. If a sheet is not available, a line may be attached to the sail 12 or to the support structure 26 that is supporting the sail 12. The line may be inserted through the opening 46 into the line containing chamber 44 of the deflection guide 38 and inserted into the releasably clamp 36, which may be a cam cleat. The line may be adjusted as needed. For instance, when waves increase and wind conditions become strong and gusty, the wind gust dampening system 10 creates a controllable elastic shock-absorber between the vessel 18 and the sails 12. The wind gust dampening system 10 may be adjustable by adjusting the number and diameter of the shock cords 14, and by hauling in or easing off the sheet that is attached by the releasable clamp 36.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A wind gust dampening system for a sailing vessel, comprising:

a first body having a first end and a second end positioned on an opposite side of the first body, wherein the first end of the first body is configured to be secured to a support structure for a sail;

a second body having a first end and a second end positioned on an opposite side of the second body, wherein the first end of the second body is configured to be secured to a deck of a vessel;

at least one shock cord extending between the first and second bodies;

a first line extending from the first end of the first body and a second line extending from the first end of the second body; and wherein the first line is releasably coupled to the first end of the first body via a releasable clamp on the first body.

2. The wind gust dampening system for a sailing vessel of claim 1, wherein the releasable clamp is a cam cleat.

3. The wind gust dampening system for a sailing vessel of claim 2, further comprising a deflection guide formed from a base attached to the first body and having an arm extending from the base and terminating proximate to the first body, thereby forming a line containing chamber and an opening into the chamber between the arm and the first body, wherein the opening is on an opposite side of the arm from the base.

4. The wind gust dampening system for a sailing vessel of claim 3, wherein the first body includes an orifice at the second end, wherein the deflection guide is positioned adjacent the first end and the cam cleat is positioned between the deflection guide at the first end and the orifice at the second end and wherein the first body includes at least one retainer extending from a first side of the first body, a second retainer having at least one load bearing surface configured to retain the at least one shock cord extending from a second side of the first body in a direction generally opposite to a direction in which the first end extends from the first body.

5. The wind gust dampening system for a sailing vessel of claim 3, wherein the first body includes a plurality of orifices at the second end to which a plurality of shock cords are releasably attached.

6. The wind gust dampening system for a sailing vessel of claim 1, wherein the at least one shock cord is attached via a permanent loop to an orifice in the first body, and the at least one shock cord is attached via a permanent loop to an orifice in the second body.

7. The wind gust dampening system for a sailing vessel of claim 1, wherein the at least one shock cord is releasably attached to the first body.

8. The wind gust dampening system for a sailing vessel of claim 7, wherein the first body includes at least one retainer having at least one load bearing surface configured to retain the at least one shock cord.

9. The wind gust dampening system for a sailing vessel of claim 1, wherein the at least one shock cord is releasably attached to the second body.

10. The wind gust dampening system for a sailing vessel of claim 9, wherein the second body includes at least one retainer having at least one load bearing surface configured to retain the at least one shock cord.

11. The wind gust dampening system for a sailing vessel of claim 10, wherein the second body is formed from an elongated body wherein the first end includes an orifice, a first retainer extending from a first side of the second body, a second retainer extending from a second side of the second body in a direction generally opposite to a direction in which the first end extends from the second body, and an orifice in the second body at the second end.

12. The wind gust dampening system for a sailing vessel of claim 10, wherein the at least one retainer in the second body is formed from a plurality of orifices at the second end to which a plurality of shock cords are releasably attached.

13. The wind gust dampening system for a sailing vessel of claim 1, wherein the at least one shock cord has first and second ends that are coupled to the first body and a midsection that extends through a retainer in the second body and wherein the retainer is at least one orifice in the second body.

14. A wind gust dampening system for a sailing vessel, comprising:

a first body having a first end and a second end positioned on an opposite side of the first body, wherein the first end of the first body is configured to be secured to a support structure for a sail;

a second body having a first end and a second end positioned on an opposite side of the second body, wherein the first end of the second body is configured to be secured to a deck of a vessel;

at least one shock cord extending between the first and second bodies;

a first line extending from the first end of the first body;

a second line extending from the first end of the second body;

wherein the first line is releasably coupled to the first end of the first body via a releasable clamp on the first body;

wherein the second body includes at least one retainer having at least one load bearing surface configured to retain the at least one shock cord;

wherein the second body is formed from an elongated body wherein the first end includes an orifice, a first retainer extending from a first side of the second body, a second retainer extending from a second side of the second body in a direction generally opposite to a direction in which the first end extends from the second body, and an orifice in the second body at the second end.

15. The wind gust dampening system for a sailing vessel of claim 14, wherein the releasable clamp is a cam cleat, further comprising a deflection guide formed from a base attached to the first body, wherein the first body includes an orifice at the second end, wherein the deflection guide is positioned adjacent the first end and the cam cleat is positioned between the deflection guide at the first end and the orifice at the second end and wherein the first body includes at least one retainer extending from a first side of the first body, a second retainer having at least one load bearing surface configured to retain the at least one shock cord extending from a second side of the first body in a direction generally opposite to a direction in which the first end extends from the first body.

16. The wind gust dampening system for a sailing vessel of claim 15, wherein the first body includes a plurality of orifices at the second end to which a plurality of shock cords are releasably attached, and wherein the at least one retainer in the second body is formed from a plurality of orifices at the second end to which the plurality of shock cords are releasably attached.

17. The wind gust dampening system for a sailing vessel of claim 14, wherein the at least one shock cord has first and second ends that are coupled to the first body and a midsection that extends through a retainer in the second body and wherein the retainer is at least one orifice in the second body.

18. A wind gust dampening system for a sailing vessel, comprising:

a first body having a first end and a second end positioned on an opposite side of the first body, wherein the first end of the first body is configured to be secured to a support structure for a sail;

a second body having a first end and a second end positioned on an opposite side of the second body, wherein the first end of the second body is configured to be secured to a deck of a vessel;

at least one shock cord extending between the first and second bodies;

a first line extending from the first end of the first body;

a second line extending from the first end of the second body;

wherein the first line is releasably coupled to the first end of the first body via a releasable clamp on the first body;

wherein the second body includes at least one retainer having at least one load bearing surface configured to retain the at least one shock cord;

wherein the second body is formed from an elongated body wherein the first end includes an orifice, a first retainer extending from a first side of the second body, a second retainer extending from a second side of the second body in a direction generally opposite to a direction in which the first end extends from the second body, and an orifice in the second body at the second end;

wherein the releasable clamp is a cam cleat;

a deflection guide formed from a base attached to the first body, wherein the first body includes an orifice at the second end, wherein the deflection guide is positioned adjacent the first end and the cam cleat is positioned between the deflection guide at the first end and the orifice at the second end;

wherein the first body includes at least one retainer extending from a first side of the first body, a second retainer having at least one load bearing surface configured to retain the at least one shock cord extending from a second side of the first body in a direction generally opposite to a direction in which the first end extends from the first body;

wherein the first body includes a plurality of orifices at the second end to which a plurality of shock cords are releasably attached; and wherein the at least one retainer in the second body is formed from a plurality of orifices at the second end to which the plurality of shock cords are releasably attached.

* * * * *